United States Patent [19]

Laurence Harold A.

[11] Patent Number: 4,839,924

[45] Date of Patent: Jun. 20, 1989

[54] SHOOTER'S HAT HAVING FLEXIBLE SIDE BLINDER ATTACHMENTS

[75] Inventor: Harold A. Laurence, Skokie, Ill.

[73] Assignee: Laurence & Laurence, Inc., Skokie, Ill.

[21] Appl. No.: 199,533

[22] Filed: May 27, 1988

[51] Int. Cl.[4] ..... A42B 1/06

[52] U.S. Cl. ..... 2/10; 2/12; 2/195

[58] Field of Search ..... 2/195, 12, 10, 177, 2/197, 172, 200, 175, 199

[56] References Cited

U.S. PATENT DOCUMENTS

| | | | |
|---|---|---|---|
| 2,218,947 | 10/1940 | Brunzell | 2/195 X |
| 3,308,478 | 3/1967 | Tate | 2/12 |
| 3,346,876 | 10/1967 | Hutton | 2/10 |
| 4,106,119 | 8/1978 | Taupin | 2/12 |

FOREIGN PATENT DOCUMENTS

| | | | |
|---|---|---|---|
| 0644095 | 4/1937 | Fed. Rep. of Germany | 2/12 |
| 0744586 | 1/1933 | France | 2/12 |
| 0258570 | 12/1948 | Switzerland | 2/12 |
| 0592424 | 10/1977 | Switzerland | 2/12 |

*Primary Examiner*—Peter Nerbun
*Attorney, Agent, or Firm*—Lacques M. Dulin

[57] ABSTRACT

Shooter's hat comprising a crown portion and an integral bill and side blinder assembly, in which the bill is characterized as being short and wide, and the side blinders are rigid but bendable forms to suit the needs of the shooter. The side blinders are characterized by having forward and rearward relieved arcuate portions, the forward portion providing wider visible flight path and the rearward portion preventing side vision distractions and light blockage without interfering with facial anatomy. The side blinders also have a lower lobe approximately coordinate with the eye position, in a front-to-back orientation, that extends below the eye socket to approximately the level of the cheek bone. As compared to the long bill loose fabric flaps of the prior art, the hat provides necessary shielding from sun and distracting peripheral light or activities, yet does not unduly restrict the angle of vision of the target flight path. The prior art hat loose side flaps can blow in the wind and move with the motion of the shooter's head, thus causing distractions and blocking the vision, which are avoided by the construction of the invention.

20 Claims, 1 Drawing Sheet

SHOOTER'S HAT HAVING FLEXIBLE SIDE BLINDER ATTACHMENTS

FIELD

This invention relates to improved hats for use while trap, skeet or target shooting. In particular, the shooter's hat of this invention prevents peripheral distractions, such as movement, air currents or sunlight from the sides. The hat is characterized by blinders which are integral with the bill of the hat and are made of rigid material so as to prevent them from being blown into the face of the user. The bill is short, preventing it from striking the gun while the user is taking aim, while at the same time affording an undistracted, wide field of view.

BACKGROUND

Trap, skeet and target shooters require concentration to achieve true aim. The movement of objects across the periphery of their vision and glare from sunlight are distracting, especially in the sport of trap or skeet shooting which involves shooting at an object as it moves rapidly in an arc across the shooter's field of vision.

The prior art teaches the use of a stiff bill or visor attached to the crown of the hat to eliminate or substantially reduce sunlight interference in the eyes of automobile drivers as in U.S. Pat. No. 3,346,876 (Hutton, 1967). The Hutton patent discloses a short visor of relatively stiff material which extends downward and around all three edges of the bill, the front as well as the two sides. The Hutton hat substantially blocks forward vision by the presence of the depending front visor, and does not eliminate movement distraction to the sides.

Other special sports hats are shown in U.S. Pat. Nos. 2,218,947 (Brunzell, 1939) for protective headgear to be worn by baseball players, and 4,356,048 (Price, 1982) for a water-impermeable bill. The crown of the Brunzell hat is made of hard material with a downwardly angled rigid bill which also has short, obliquely angled, tapered wing-like extensions at the sides to protect the temples of the wearer. Since the human temple is located adjacent and behind the eye sockets, it is possible to protect the temples without affecting the peripheral line of vision. The Brunzell temple-guards are of such short length and particular angle as to not block peripheral vision distractions, nor to assist the wearer to focus on forward vision targets.

Other hats function to keep the ears, neck and head of the wearer warm. One such hat is shown in U.S. Pat. No. 1,505,183 (Zucker, 1924) whose hat has a detachable rear flap for keeping the ears and back of the neck of the wearer warm and dry. A similar hat is shown in U.S. Pat. No. 3,134,983 (Lipkin, 1964) which is directed to a knitted, fold down ear and back of the neck flap having a layer of polyurethane foam laminated between the inner and outer layers of knitted material giving the hat structure and flexibility. Whipple 32,849 (1861) shows a military cap in fedora style having a soft felt crown and flared rear soft felt brim (called a cape), which brim tapers at the sides to a stiff leather bill in the front. Neither the Zucker, Lipkin, nor Whipple hat teaches the use of side blinders specially adapted to block distracting movements or sunlight from the peripheral vision of the shooter.

There is a commercially available hat, called the "Yupong" Korean hat, for use by hunters and target shooters. It has a fabric crown with a long bill and a pair of flexible side flaps. These side flaps may be attached to the top of the bill using velcro material. The bill consists of a rigid material, while the side blinders and crown are of non-rigid fabric material. Velcro patches are attached to the under-side of the flaps, extending $\frac{1}{4}$–$\frac{3}{4}$ inch onto the under-side of the bill. Velcro patches are also located on the top forward portion of the flaps, and on the top forward section of the bill. Since the flaps are non-rigid, they may be folded up and rested on the top of the bill when not in use. The velcro on the top surface of the bill and side flaps serves to secure the flaps in that position.

This Yupong hat is a step in the wrong direction because the bill is long and cuts down the forward angle of vision, critical for trap, skeet and target shooters. Further, the soft fabric sides flap more easily in the wind and lag behind with motion of the shooter's head. Thus, they accentuate side vision distraction and unduly narrow the field of view. This Yupong hat causes false or delayed target acquisition, resulting in lower scores.

There is thus a great need for a shooter's hat that screens out distractions in the human range of peripheral vision while preserving the maximum useful horizontal and vertical range of vision.

THE INVENTION

OBJECTS

It is among the objects of the invention to provide a special shooter's hat with side blinders integral with a short, straight bill which prevents peripheral distractions such as movement, air currents and sunlight while trap, skeet or target shooting.

It is another object of the invention to provide a hat with a bill and side blinders assembly constructed of a rigid material intended to retain its position and shape, yet which can be adjusted by the wearer to afford maximum protection and convenience.

It is another object of the invention to provide a hat which has one relaxed, storage form to reduce inventory of retailers, and another operative, stressed form which is achieved upon placing the hat on the wearer's head.

It is a further object of the invention to provide a hat with an adjustable snap band which allows the wearer to adjust the hat to a comfortable, secure fit while minimizing the possibility of the hat being blown off the head of the wearer.

It is another object of the invention to provide a hat the crown of which is partially comprised of nylon mesh material which will provide ventilation.

It is another object of the invention to provide a hat which has a loop on the top for securing such devices as protective ear plugs, and which will not be a discomfort when used in conjunction with ear mufflers, ear phones and other such accessories.

It is another object of the invention to provide a hat which comprises a bill and side blinders assembly having a black undercoating which will minimize glare reflecting off of the bottom of the assembly into the eyes of the wearer.

Still further and other objects of the invention will be evident from the Summary, Drawings, and Detailed Description of Best Mode of the invention.

SUMMARY

Trap, skeet and target shooters require concentration to accurately shoot their targets. Movement in the shooter's peripheral vision, glare from sunlight, and wind borne dust, etc. may distract the shooter in such a way as to reduce the accuracy of the shots. The present invention is an improvement on a shooter's hat which has a short bill and integral rigid side blinders specially adapted to reduce such distractions and permit the shooter to better focus on the target in the forward field of view. The short bill of the present invention is superior to the prior art, having a bill approximately 58% shorter than the bill in the prior art as measured from the front edge of the crown to the forward end of the bill. The shorter bill does not hit against the barrel of the gun as the wearer is taking aim. Additionally, the shorter, rigid bill bows when it is operatively placed on the wearer's head. By bowing, the effective edge of the bill is raised, thus increasing the wearer's vertical vision. The effective length of the side blinders in the present invention is approximately 55% that of the side blinders in the prior art hat, making it functionally superior.

The bill and side blinders assembly is made of a rigid but flexible vinyl material which will not move in the wind, or with movement of the wearer's head yet which is adjustable i.e. the blinders can be bent at their juncture with the bill for closer individual fit. The rigidity feature is critical to achieve the purpose for which this shooter's hat is specially adapted. The prior art hat has side flaps made of non-rigid fabric material, which are longer at the critical depth than the rigid side blinders of the present invention. Loose side flaps such as those found in the prior art, blow in the wind, or flap when the shooter moves his/her head to follow the flight path of the target while tracking just prior to shooting. When the side flaps move, they not only cut off the vision, but they are additional distractions to the shooter. The shorter, rigid side blinders of the shooter's hat of the present invention remain stationary while the wearer's head moves as it tracks the target.

The side blinders of the present invention have a specially adapted forward relieved arcuate portion to maximize the horizontal vision of the wearer. The forward relieved portion increases the horizontal vision by approximately 176% over the prior art hat. This is important in trap and skeet shooting where the shooter must track the target across the horizontal field of view. In the sport, targets are shot out randomly from one side or another of the shooter. The earlier the shooter can spot and begin to track the target, the more accurate the shot. When the horizontal field of vision is substantially impaired, as it is with the prior art hat, it acts to hinder not aid the wearer.

The side blinders of this invention also have a rearward relieved arcuate portion to clear the cheek bone and muscles adjoining the jaw bones. The rearward relieved portion of the side blinders in the present invention block light leakage from the sides without touching against the cheek or jaw muscles of the wearer. A shooter may clench his/her teeth, causing the mandibular muscles over the jaws to move. If the hat were to rest on this muscle in any way, as it does in the prior art hat, the result would be movement of the hat, head and gun.

The invention has additional preferred features which aid in the functionality and comfort for the user. The underside of the bill and side blinders assembly is covered with a black, nonglare fabric which absorbs sunlight instead of reflecting it into the eyes of the wearer. The crown of the hat is divided with six vertically oriented triangular panel (or gore) areas, the rearward four of which are formed of a nylon open mesh material for ventilation. The front two panel areas are preferably formed of a single piece of padded material, with a vertical tuck for maintaining the structure of the hat, and to which items such as pins and awards may be attached. The crown of the hat is topped with a loop through which such devices as ear plugs or shooter's protective ear cups can be threaded to keep them positioned properly. The loop is made of a fabric material and preferably has velcro closure strips. The inner circumference of the hat (the headband) includes an absorbent band for keeping sweat from running into the wearer's eyes while shooting. The hat also has an adjustable back strap for universal fit. This not only provides a better fit for the user, but also reduces the required inventory of retailers carrying the hat.

Due to the rigid material comprising the bill and side blinders assembly, and the tight fit of the hat, the hat of this invention has two forms. The first form is the relaxed storage form during which the side flaps project at approximately 45° outwardly from the horizontal plane of the bill. While in this form, the plane of the bill is relatively flat. The second form is the operative stressed form, into which the integral blinders and bill assembly flexes when the hat is worn by the shooter. When placed on the head, the side flaps move inwardly to a nearly vertical position as compared to the generally horizontal plane of the bill. The bill is also flexed to form a concave down plane and the front edge of the bill arcs up, thereby increasing the vertical field of vision when in use. Once operatively positioned, the hat provides wide horizontal and vertical fields of vision which are important in tracking the moving target at which the wearer is aiming. The rigid side blinders, with the forward and rearward relieved portions, effectively block distracting movement in the wearer's peripheral vision without inhibiting the ability to acquire and track the target.

DRAWINGS

DETAILED DESCRIPTION OF THE BEST MODE:

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
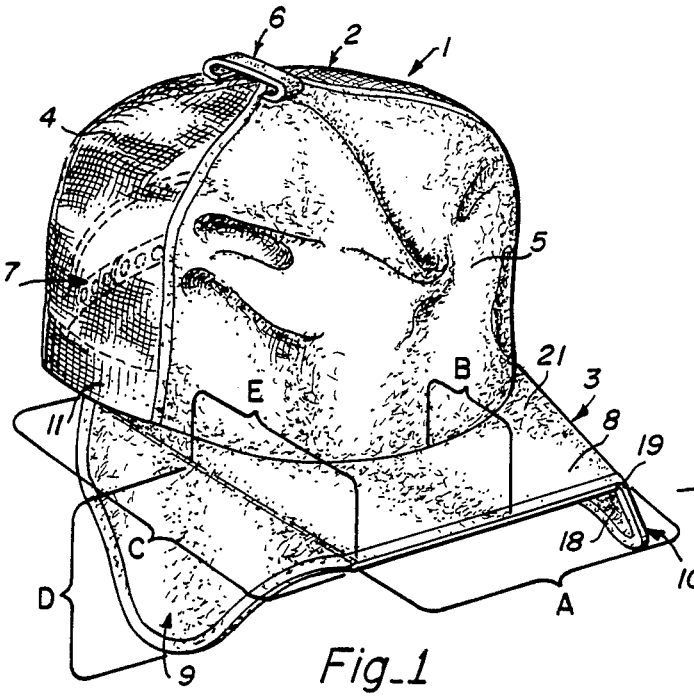
FIG. 1 is a three-quarters front elevated perspective view of the shooter's hat of this invention in its relaxed, storage form.

FIG. 1 shows the shooter's hat 1 of this invention in three quarters elevated front perspective in its relaxed, storage form. The hat comprises a round crown portion 2 with a bill and blinder assembly 3. The crown portion 2 is a substantially standard multi-gore nylon mesh hat having a plurality of side and rear gores 4 of open mesh and a solid fabric front portion 5. The hat may optionally have a loop 6 at the peak of the hat for securing the head band portion of shooter's ear plugs (not shown). In addition, the rear portion of the hat may have the standard adjustment strap 7.

Figure 3:
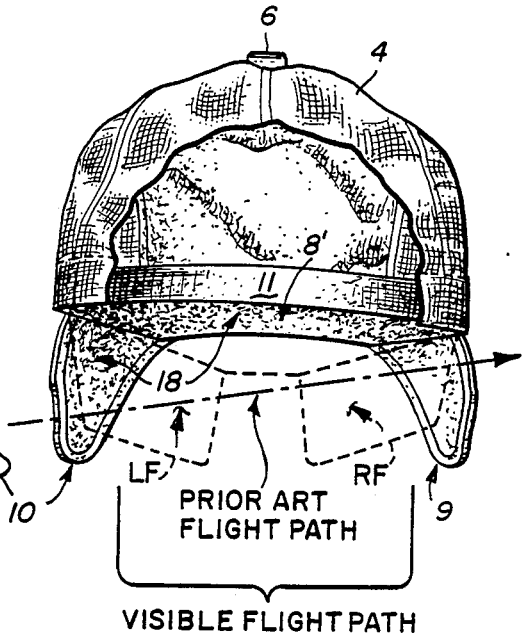
FIG. 3 is a rear perspective view of the hat in its operative stressed form showing the wider field of view of the hat of the present invention as compared to the prior art which is showed in dashed lines.
Figure 4:
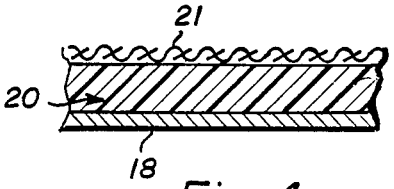
FIG. 4 is an enlarged partial section view of the construction of the rigid but bendable bill and side blinder material.

Attached to the front of the hat at the lower marginal edge, of the circumferential head band 11, is a bill and blinder assembly 3. This assembly 3 comprises a bill portion 8, and two, spaced apart, opposed side blinder portions 9 and 10. As best seen in FIG. 4, it is important to note that the bill and blinder assembly 3 is basically a laminate of a fabric upper surface 21, a substantially rigid but semi-flexible inner core 20, preferably a vinyl material, and a lower fabric covering 18. The layers are preferably attached using any standard fabric-to-plastic adhesive. The top-most fabric may be made water-impermeable, as for example by use of a silicone fabric treatment material. The lower fabric material is black to cut down glare and give eye-relief contrast to help the shooter focus on the visual flight path area forward of the bill and blinder assembly. The black covering 18 covers the inner surface of both the side blinders and the underside of the bill, and is best shown in FIG. 3, a perspective view from behind the hat in its operative stressed position looking forward to show the field of view.

Even though the vinyl core material 20 may be colored black for light absorption, a smooth surface 18 cannot be used as the angle of incidence of light is too close to the plane of the bill, and will be reflected. Accordingly, the underside of the bill and inner surface of the blinders must have a textured or roughened surface to prevent light or glare reflection. Covering these surfaces with black cloth 18 is the preferred method of light control, but providing a pebble grained or roughened surface directly on or in the plastic core material without use of fabric 18 is an alternative.

A critical feature of the invention is the provision of a special core material which must be rigid but bendable to conform to the shape desired by the shooter. The importance of the rigid side blinders 9 and 10 cannot be over-emphasized. If the side blinders are loose flaps, they can blow in the wind, or flap when the shooter moves his/her head to follow the flight path of the target while aiming just prior to shooting. When the side flaps move, they cut off the vision and allow light to leak and distract the shooter. If the side flaps vertically hang down too far they touch the shooter's face, causing further distractions.

Further, the dimensions of the bill and blinder assembly 3 are extremely important to the effectiveness of the shooter's hat of this invention. As shown best in FIGS. 1 and 2, bill length B is preferably relatively short, approximately $2\frac{1}{4}''$. This permits a sufficiently wide forward field of view because the beam A is quite wide, being approximately $5\frac{1}{2}''$. In the prior art type of hat, as shown in dotted lines in FIGS. 2 and 3, the bill is exceedingly long and side flaps hang down loosely. A horizontal visible flight path in the prior art type of hat is very narrow, being only approximately 85°, with a vertical flight path of approximately 12°. With the short bill, wide beam hat of this invention, the horizontal flight path is approximately 150°, with a vertical flight path of approximately 25°. Further, the prior art side flaps are loose fabric which flap easily in the breeze and with the motion of the shooter's head, at times completely obscuring the field of view and causing unnecessary and unpredictable distractions.

Figure 2:
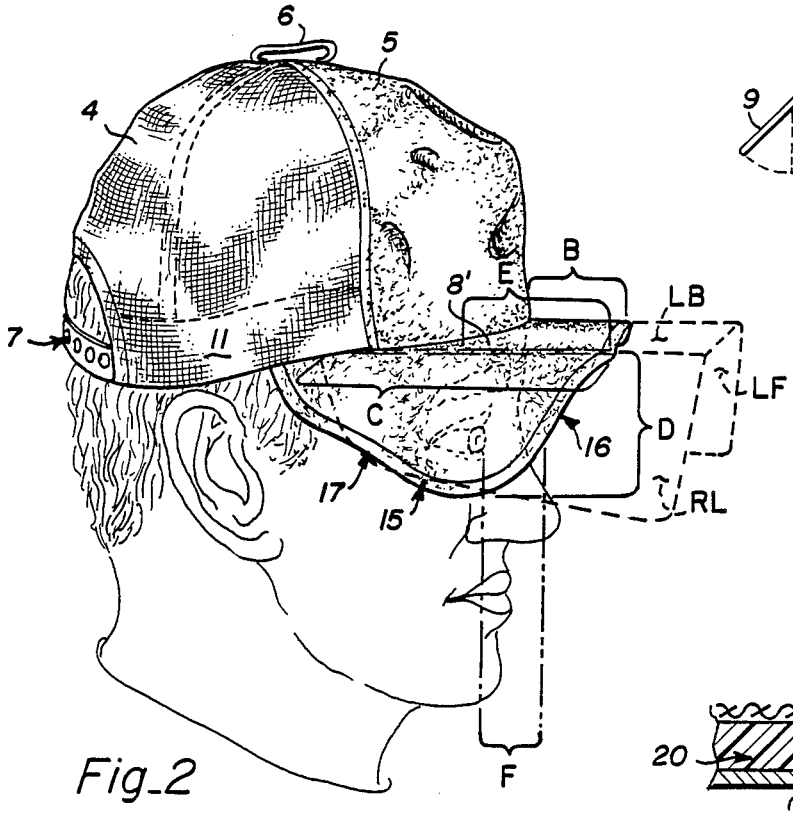
FIG. 2 is a side elevation view of the hat in its flexed use form on the head of a wearer showing the relationship of the side blinder to the shooter's eye, and showing in dashed lines the prior art long bill flexible side flap type hat.

As best seen in FIG. 2, the side blinders configuration of this invention is also extremely important. Note that the vertical depth of the side blinders D, being on the order of $2\frac{1}{4}''$–$2\frac{3}{4}''$ is deep enough to come below the level of the bottom of the eye socket, and is generally coordinate with the cheek bone of the wearer. This extended lower lobe 15 is set back from the leading edge of the bill 8 by the amount E, which is on the order of $2\frac{1}{4}$ to $2\frac{1}{2}''$. Thus, this sets the center portion of the arcuate lower lobe extension along a line approximately vertically downward from the front edge of the bill 8. This is approximately half the length of the bill where it joins the side of the headband 11 as shown by the dimension C on FIGS. 1 and 2.

In addition, there is a forward relieved arcuate portion 16 which is important in providing the proper field of view. In contrast with the prior art blinders, in which the flaps are substantially vertical straight lines from the forward edge of the bill, the relieved arcuate portion 16 provides an additional approximately 20°–30° of field of view.

There is also a rearward relieved arcuate portion 17 to the side blinders 9 and 10. This serves the function of following the contour of the lower portion of the wearers temple, jawbone and cheekbone, so that flexing of the cheek muscles or jaw muscles does not cause the blinder or bill portion rigidly attached thereto to move during shooting. The arcuate portion is not relieved so much as to provide light leakage from behind, which would cause distraction, but is relieved sufficiently to provide clearance for the shape of the wearers face (temple, cheek, cheekbone, etc.).

FIG. 3 shows the visual flight path of the present invention as compared to the prior art. The prior art "long bill" hat is shown in dashed lines, whereas the present invention is shown in solid lines. As best seen in FIG. 3, the prior art visible flight path is very small providing the shooter with only a fraction of a second of "look" at the target in which to acquire, track, aim and fire. It also forces the shooter to move his or her head to follow the flight path and in so doing, the side flaps, being flexible fabric, will move. Since the prior art fabric flaps have some weight when the shooter first begins the movement of the head, the leading flap will lag behind because of its inertia, and will obscure even more of the forward end of the flight path. The trailing flap will let light enter. This flat movement will distract the shooter.

In contrast, as best seen in FIG. 3, the hat of the present invention permits the flight of the target to be picked up very easily when it first appears and followed for appropriate timing to "lead" the shot without introducing distractions by moving flaps. As the shooter leads the shot, rotating the gun and his/her head, the rigid blinders do not move in the wind or lag due to inertia and there is no fluttering or change in the field of view to the sides.

Further, in the prior art hat, the bill is so long that it requires the user to employ an unnatural angle or "cocking" of the users head, e.g. raising the head, to keep it from interfering with the gun barrel. The present invention has a bill which is approximately 58% shorter as compared with the prior art bill. This difference in measurements is significantly different in its use. The wearer can take aim and track the target without the bill of the hat hitting the barrel of the gun or in any other manner interfering with the shot.

In short, the prior art Yupong hat is more a hinderance than a help as it requires the shooter to learn new techniques and new head angles in order to achieve a shot. FIG. 2 shows the long tapered bill (LB), the right flap (RF) and the left flap (LF) of the prior art hat in dashed lines. The bill is so long and heavy that the hat slips down on the forehead or causes the shooter to drop his head, thus changing the attitude of the eye angle with respect to the shotgun. Also note that the rearward portion of the flaps (LF) or (RF) vertically hangs down too far, thus striking the cheek musculature, causing distraction of the shooter.

Returning to the hat of this invention, the underside of the of the bill and side blinders assembly 18 is blackened to absorb light and permit visual contrast, and is textured to reduce glare. FIG. 1 shows that there is a continuous edge tape (19) along the margins of bill and side blinders assembly (3) that may be sewed or glued onto the leading edge thereof. This forms a crisp well-defined edge, and prevents unraveling of the fabric covering.

FIG. 4 shows in cross section the bill and blinder assembly laminate. It comprises an inner core 20, preferably of matte black rigid vinyl (0.040" thick) covered with an upper fabric covering of any desired color 21, and a lower underside covering 18 of black fabric. The fabric may be stretched taut over the core, and is preferably bonded to the vinyl with a suitable standard fabric-to-plastic adhesive such as a 3M FASTBOND brand No. 34 translucent adhesive containing petroleum distillate, toluene and hexane. The fabric is preferably a lightweight, blended polyester/cotton twill fabric (typically 2×1, 80×56 twill for the underside black fabric, and 3×1, 88×42 twill for the top surface fabric), which top surface has been silicone fabric treated to make it water-resistant.

Figure 5:
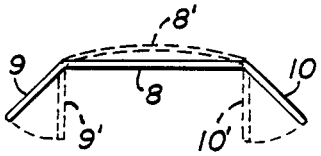
FIG. 5 is a partial front elevation view of the visor portion of the hat showing the relaxed storage position of the hat as compared to the operative stressed position of the hat which is shown in dashed lines.

FIG. 5 shows a front view of the present invention in its two forms. The first form, as shown in solid lines, is that of the hat in relaxed, storage position. The front bill edge 8 is substantially straight, and is generally parallel to a chord of the arc defining the point of attachment of the crown to the bill. This chord is defined as a straight line spanning the circumference of the crown, and may be the diameter of the crown. The side blinders 9 and 10 are canted outwardly approximately at a 45° angle down from the horizontal plane of the bill. The second form, as shown in dashed lines, is that of a hat as it appears when operative i.e. when worn. This second, stressed position is characterized by a substantially arcuate front bill 8' which is still planar but concave down. The side blinders 9' and 10', assume a nearly 90° position relative to the bill 8'. The effect of the second form of the present invention is to substantially increase the vertical field of vision when the hat is operatively placed on the wearer's head.

By way of specific example, Table I shows a comparion of the shooter's hat of this invention as compared to the Yupong prior art long bill hat. The dimensions show in Table I are the dimension identified in FIG. 1 and 2.

TABLE I

| | Shooter's HAT OF THE INVENTION (inches) | LONG BILL PRIOR ART HAT (inches) | PERCENTAGE DIFFERENCE (invention/ prior art) |
|---|---|---|---|
| A | 5.50 | 4.50 | 122 |
| B | 2.25 | 3.90 | 58 |
| C | 5.00–5.40 | 6.40 | 78–84 |
| D | 2.40–2.80 | 3.06–3.12 | 85 (avg) |
| E | 2.25–2.375 | 2.60–2.75 | 86 (avg) |
| F | 1.75 | 3.375 | 55 |
| Flight path visual field: | | | |
| horizontal vision | 150° | 85° | 176 |
| vertical vision | 25° | 12° | 208 |

Legend:
A: Front width of bill (beam), preferred length range 5.5 to 6.0".
B: Length of bill, preferred length range 2.25–2.50".
C: Bill/blinder marginal juncture length.
D: Vertical depth of blinder at eye socket, preferred range 2.40–2.80".
E: Length of bill from deepest part of blinder to front.
F: Length, eye to effective edge of side blinder, preferred length range 1.75–2.125".

While these measurements are based on a representative embodiment of the invention and the prior art hat, the measurement may vary a little but the proportions should be the same. The length of the bill of the shooter's hat of this invention is approximately 58% of the length of the shooter's hat while the width (beam) of the front edge of the bill is 122% the width the prior art hat.

Measurement F represents the distance from the wearer's eyes to the effective end of the blinders. Due to the arcuate nature of the shooter's hat blinders of the invention while the hat is worn, the wearer's field of vision is widened. The arcuate relieved portion 16 serves to make the effective end of the blinders where the moving target is first acquired much shorter than the actual measured length of the bill, 8.

The difference between the two hats is best shown in FIG. 3. Upon comparing the two hats in actual use trials, it was found that the short bill, rigid side blinders hat of this invention provided many unique and advantageous features as compared to the prior art long bill loose fabric blinder hat of the prior art. Among these are wider angle of view, better light blockage on the sides, no distraction upon moving of the head by virtue of the side blinders moving in the wind or with the head motion, no change in the head attitude angle, and no interference with the face by virtue of the rear relieved portion 17. Further, the black underside prevented glare and reflections into the eye. Shooters experimentally testing the hat of this invention found it easy and effective to use.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

PARTS LIST

1—hat
2—crown portion
3—bill & blinder assembly
4—plurality of side and rear gores
5—solid fabric front portion
6—loop on top of hat
7—standard adjustment strap
8—bill portion - relieved form 8'—bill portion - stressed form
9—left side blinder (viewed from the front of hat) - relieved
9'—left side blinder - stressed form
10—right side blinder - relieved form
10'—right side blinder - stressed form
11—circumferential headband
15—extended lower lobe of side blinder
16—forward arcuate relieved portion
17—rearward arcuate relieved portion
18—underside of bill and blind assembly
19—continuous edge tape
20—inner core of bill and blinder assembly
21—upper fabric covering of bill and blind assembly
LB—LB prior art long bill
LF—prior art left side flap
RF—prior art right side flap

I claim:

1. In a shooter's hat having in combination:
(A) a generally hemispherical crown having a peak and a generally circular margin defined by a band to generally encircle the head;
(B) a bill attached to said crown adjacent a forward portion of said margin;
(C) depending side flaps attached to said bill for restricting vision;

the improvement wherein:
(a) said bill comprises a generally planar member having a first marginal edge that extends along an arc and generally conforms to the shape of a wearer's head;
(i) said bill being attached to said crown along said arcuate first marginal edge to define a forward portion on said hat;
(ii) said bill having a generally straight second marginal edge spaced from said first edge, parallel to a chord of said arc and defining a front edge of said bill;
(iii) said second front marginal edge being shorther than a chord which extends along the diameter of the crown margin;
(iv) said bill having a pair of spaced apart, generally straight, opposed third and fourth marginal edges intersecting said first and second marginal edges;
(b) a first and a second vision-restrictive rigid side blinder attached to and depending from said third and fourth marginal edges, respectively, of said bill;
(i) said depending side blinders and said bill defining in cross-section a generally truncated A-shaped structure in its relaxed storage form;
(ii) said depending side blinders and said bill defining in cross-section a generally inverted U-shaped shaped structure in its operative stressed position upon a wearer's head providing defined horizontal and increased vertical fields of view bounded at a top and sides;
(iii) said depending side blinders flex into said U-shaped structure and said bill bows into a concave down configuration when said hat is placed operatively upon the wearer's head;
(iv) said bill and side blinders being flexibly rigid such that said side blinders are bendably positionable along their juncture with said bill yet retain their shape once operatively positioned.

2. An improved shooter's hat as in claim 1 wherein:
(a) each of said depending side blinders comprises a plurality of marginal edges forming a generally triangular planar structure bounded by said structure, and in which:
(i) a first blinder edge defining the base of said triangular structure and forming a line along which said side blinder attaches to said third or fourth marginal edge of said bill;
(ii) a second blinder edge, one end of which begins at the intersection of said third or fourth marginal edge of said bill and the second marginal edge of said bill, defining a forward blinder edge of said side blinder;
(iii) said forward blinder edge having a forward relieved portion disposed adjacent said intersection to form a downwardly and forwardly oriented concave arc to provide for a wider horizontal field of vision for the wearer.

3. An improved shooter's hat as in claim 2 wherein:
(a) said second blinder edge terminates at the intersection of said first marginal bill edge with said head-band to form a back blinder edge of said side blinder; and
(b) said back blinder edge having a rearward relieved portion disposed adjacent said termination of the second blinder edge to form a shallow arc concave-down, to provide cheek musculature clearance and so that said blinder does not interfere with use of shooter's ear protection devices.

4. An improved shooter's hat as in claim 3, wherein:
(a) said forward and rearward relieved blinder edge portions being spaced from each other, and being joined by a continuous arcuate convex-down central blinder edge portion, and
(b) said blinder central edge portion extending downwardly from said juncture of said side blinder with said bill to below about the lowest portion of the eye socket of a wearer when said hat is worn in normal operative position.

5. An improved shooter's hat as in claim 4 wherein said bill and said depending side blinders are formed from a single piece of integral, bendable rigid material.

6. An improved shooter's hat as in claim 5 wherein said integral material comprises a laminate having a core of vinyl material and an upper fabric surface adhered thereto.

7. An improved shooter's hat as in claim 6 wherein said laminate includes a textured lower surface.

8. An improved shooter's hat as in claim 7 wherein said textured surface comprises a black fabric adhered to said vinyl material.

9. An improved shooter's hat as in claim 6 which includes means for retainingly engaging a shooter's ear protective device, said means being disposed adjacent the peak of said hat crown.

10. An improved shooter's hat as in claim 9 wherein said means is a loop adapted to receive a connecting member of said ear protective device.

11. An improved shooter's hat as in claim 1 wherein:
(a) said second blinder edge terminates at the intersection of said first marginal bill edge with said head-band to form a back blinder edge of said side blinder; and
(b) said back blinder edge having a rearward relieved portion disposed adjacent said termination of the second blinder edge to form a shallow arc concave-down, to provide cheek musculature clearance and so that said blinder does not interfere with use of shooter's ear protection devices.

12. An improved shooter's hat as in claim 5 wherein said crown has a back portion of open mesh, and a size-adjustable headband.

13. An improved shooter's hat as in claim 8 wherein said crown has a back portion of open mesh, and a size-adjustable headband.

14. An improved shooter's hat as in claim 10 wherein said crown has a back portion of open mesh, and a size-adjustable headband.

15. An improved shooter's hat as in claim 5 wherein:

(a) the length of said second marginal edge defining the front edge of said bill, from the juncture of the second marginal edge with the third marginal edge to the juncture of the second marginal edge with the fourth marginal edge, is in the range of from about 5.5 to about 6.0 inches;

(b) the length of the bill, defined by the distance between the midpoint of the first marginal edge to the midpoint of the second marginal edge, is in the range of from about 2.25 to about 2.50 inches;

(c) the depth of the side blinders at said blinder central edge portion, defined by the distance between the third or fourth marginal edge and the lowest point on said side blinder central edge portion, is in the range of from about 2.40 to about 2.80 inches.

16. An improved shooter's hat as in claim 15 wherein the effective length of the bill is in the range of from about 1.75 to about 2.125 inches.

17. An improved shooter's hat as in claim 8 wherein:

(a) the length of said second marginal edge defining the front edge of said bill, from the junction of the second marginal edge with the third marginal edge to the junction of the second marginal edge with the fourth marginal edge, is in the range of from about 5.5 to about 6.0 inches;

(b) the length of the bill, defined by the distance between the midpoint of the first marginal edge and the midpoint of the second marginal edge, is in the range of from about 2.25 to about 2.50 inches.

(c) the depth of the side blinders at said eye position, defined by the distance between the third or fourth marginal edge and the lowest point on said side blinder is in the range of from about 2.40 to about 2.80 inches.

18. An improved shooter's hat as in claim 17 wherein the effective length of the bill is in the range of from about 1.75 to about 2.125 inches.

19. An improved shooter's hat as in claim 12 wherein:

(a) the length of said second marginal edge defining the front edge of said bill, from the junction of the second marginal edge with the third marginal edge to the junction of the second marginal edge with the fourth marginal edge, is in the range of from about 5.5 to about 6.0 inches;

(b) the length of the bill, defined by the distance between the midpoint of the first marginal edge and the midpoint of the second marginal edge, is in the range of from about 2.25 to about 2.50 inches;

(c) the depth of the side blinders at said eye position, defined by the distance between the third or fourth marginal edge and the lowest point on said side blinder is in the range of from about 2.40 to about 2.8 inches.

20. An improved shooter's hat as in claim 19 wherein the effective length of the bill is in the range of from about 1.75 to about 2.125 inches.

* * * * *